US012246219B2

(12) United States Patent
Aly et al.

(10) Patent No.: US 12,246,219 B2
(45) Date of Patent: Mar. 11, 2025

(54) DYNAMIC ADJUSTABLE EXERCISE SYSTEM

(71) Applicant: Kabata, Inc., Marina del Rey, CA (US)

(72) Inventors: Kareem Aly, Marina del Rey, CA (US); Brian P. Lovera, Downey, CA (US); Vladimir Joukov, Thornhill (CA); Michael Chad Makay, Santa Clara, CA (US)

(73) Assignee: Kabata, Inc., Los Angeles, CA (US)

( * ) Notice: Subject to any disclaimer, the term of this patent is extended or adjusted under 35 U.S.C. 154(b) by 267 days.

(21) Appl. No.: 17/726,276

(22) Filed: Apr. 21, 2022

(65) Prior Publication Data

US 2022/0355163 A1 Nov. 10, 2022

Related U.S. Application Data

(60) Provisional application No. 63/186,613, filed on May 10, 2021.

(51) Int. Cl.
*A63B 24/00* (2006.01)
*A63B 21/00* (2006.01)
(Continued)

(52) U.S. Cl.
CPC .... *A63B 24/0062* (2013.01); *A63B 21/00065* (2013.01); *A63B 21/0604* (2013.01);
(Continued)

(58) Field of Classification Search
CPC ..... A63B 24/0062; A63B 21/00065; A63B 21/0604; A63B 21/0726;
(Continued)

(56) References Cited

U.S. PATENT DOCUMENTS 7,578,771 B1 8/2009 Towley et al.
7,758,478 B2 7/2010 Golesh et al.
(Continued)

FOREIGN PATENT DOCUMENTS

AU 2019216445 A1 * 9/2020 ..... A63B 21/00065
CN 201482056 U 5/2010
(Continued)

OTHER PUBLICATIONS

International Search Report and Written Opinion dated May 5, 2022 from International Application No. PCT/US2022/027880.

*Primary Examiner* — Sundhara M Ganesan
*Assistant Examiner* — Jacqueline N L Loberiza
(74) *Attorney, Agent, or Firm* — Beyer Law Group LLP

(57) ABSTRACT

An adjustable weight exercise system is provided. A permanent weight assembly and a plurality of interlocking weights are provided. A base comprises an interlocking weight carrier, wherein the interlocking weights are supported on the interlocking weight carrier and an interlocking weight selector, wherein the interlocking weight selector is adapted to cause interlocking weights to be set to be locked to the permanent weight assembly while the permanent weight assembly is not on the base, wherein placement of the permanent weight assembly on the base causes interlocking weights that are set to be locked to the permanent weight assembly to be locked to the permanent weight assembly, and wherein placement of the permanent weight assembly on the base does not cause interlocking weights that are not set to be locked to the permanent weight assembly to be locked to the permanent weight assembly.

14 Claims, 10 Drawing Sheets

(51) Int. Cl.
*A63B 21/06* (2006.01)
*A63B 21/072* (2006.01)

(52) U.S. Cl.
CPC .. *A63B 21/0726* (2013.01); *A63B 2024/0065* (2013.01); *A63B 2024/0071* (2013.01); *A63B 2220/34* (2013.01); *A63B 2220/56* (2013.01); *A63B 2220/833* (2013.01); *A63B 2230/06* (2013.01)

(58) Field of Classification Search
CPC .... A63B 2024/0065; A63B 2024/0071; A63B 2220/34; A63B 2220/56; A63B 2220/833; A63B 2230/06
See application file for complete search history.

(56) References Cited

U.S. PATENT DOCUMENTS

| | | | | |
|---|---|---|---|---|
| 8,206,274 | B2 | 6/2012 | Svenberg | |
| 8,394,004 | B2 | 3/2013 | Towley et al. | |
| 9,776,032 | B2 | 10/2017 | Moran et al. | |
| 9,943,719 | B2 | 4/2018 | Smith et al. | |
| 10,065,064 | B2 | 9/2018 | Smith et al. | |
| 10,071,285 | B2 | 9/2018 | Smith et al. | |
| 10,099,083 | B1 | 10/2018 | Owusu | |
| 10,232,214 | B2 | 3/2019 | Svengberg | |
| 10,463,906 | B2 | 11/2019 | Owusu | |
| 10,843,028 | B2 | 11/2020 | Nalley et al. | |
| 10,933,272 | B2 | 3/2021 | Polinsky | |
| 11,219,795 | B1 | 1/2022 | Yao | |
| 2014/0221175 | A1 | 8/2014 | Liu | |
| 2016/0059064 | A1* | 3/2016 | Smith | A63B 24/0062 482/5 |
| 2016/0089560 | A1 | 3/2016 | Smith et al. | |
| 2016/0101320 | A1 | 4/2016 | Tsutsui et al. | |
| 2016/0184623 | A1* | 6/2016 | Moran | A63B 21/075 482/8 |
| 2021/0008413 | A1* | 1/2021 | Asikainen | G06F 3/0304 |
| 2021/0205658 | A1 | 7/2021 | Patel et al. | |
| 2021/0308524 | A1 | 10/2021 | Cernasov et al. | |
| 2022/0257994 | A1* | 8/2022 | Smith | A63B 24/0087 |

FOREIGN PATENT DOCUMENTS

| | | | | |
|---|---|---|---|---|
| DE | 19532254 | | 10/1996 | |
| EP | 0850667 | A2 | 1/1998 | |
| JP | 2003102865 | | 4/2003 | |
| WO | 2008/071029 | A1 | 6/2008 | |
| WO | WO-2015195155 | A1 * | 12/2015 | A63B 21/063 |
| WO | WO-2020027608 | A1 * | 2/2020 | A63B 21/0004 |
| WO | 2022/051272 | | 3/2022 | |

* cited by examiner

DYNAMIC ADJUSTABLE EXERCISE SYSTEM

CROSS REFERENCE TO RELATED APPLICATIONS

This application claims priority under 35 U.S.C. § 119 from U.S. Application No. 63/186,613, filed May 10, 2021, entitled DYNAMIC ADJUSTABLE FREE WEIGHT EXERCISE EQUIPMENT WITH HAPTIC FEEDBACK AND WIRELESS CONNECTIVITY, by Aly et al., which is incorporated herein by reference for all purposes.

BACKGROUND

The background description provided here is for the purpose of generally presenting the context of the disclosure. Information described in this background section, as well as aspects of the description that may not otherwise qualify as prior art at the time of filing, are neither expressly nor impliedly admitted as prior art against the present disclosure.

The invention relates to an exercise system. The invention more specifically relates to an adjustable weight system.

The problem with working out and dumbbells today is delayed gratification. Namely, because they are not the most straightforward or engaging to use and the human body is slow to illustrate changes externally. As a result, many people do not maintain proper exercising regimes for significant periods of time.

SUMMARY

To achieve the foregoing and in accordance with the purpose of the present disclosure, an adjustable weight exercise system is provided. A permanent weight assembly and a plurality of interlocking weights are provided. A base comprises an interlocking weight carrier, wherein the interlocking weights are supported on the interlocking weight carrier, and an interlocking weight selector, wherein the interlocking weight selector is adapted to cause interlocking weights to be set to be locked to the permanent weight assembly while the permanent weight assembly is not on the base, wherein placement of the permanent weight assembly on the base causes interlocking weights that are set to be locked to the permanent weight assembly to be locked to the permanent weight assembly, and wherein placement of the permanent weight assembly on the base does not cause interlocking weights that are not set to be locked to the permanent weight assembly to be locked to the permanent weight assembly.

In another manifestation, an exercise weight system is provided. A free weight is provided with a haptic device within the free weight.

In another manifestation, an exercise system is provided. An adjustable force exercise tool comprises a force adjuster for adjusting force provided by the exercise system and a feedback device. A sensor is adapted for sensing at least one of movement, acceleration, linear and angular velocity, position, temperature, pressure, magnetic field, heart rate, radio frequency, sound waves, and orientation. A controller is adapted to use data from at least one of movement, acceleration, linear and angular velocity, position, temperature, pressure, magnetic field, heart rate, radio frequency, sound waves, and orientation from the sensor to control the force adjuster and feedback device.

In another manifestation, an adjustable weight exercise system is provided. A permanent weight assembly comprises a handle with a first end and a second end, a first weight connected to the first end of the handle with a first side facing towards the second end of the handle and a second side facing away from the second end of the handle, and a second weight connected to the second end of the handle with a first side facing towards the first end of the handle and a second side facing away from the first end of the handle. A first interlocking weight is adapted to lock to the second side of the first weight, wherein the first interlocking weight has a first side that is adapted to lock to the second side of the first weight and a second side facing away from the first weight. A second interlocking weight that is adapted to lock to the second side of the second weight, wherein the second interlocking weight has a first side that is adapted to lock to the second side of the second weight and a second side facing away from the second weight.

These and other features of the present disclosure will be described in more detail below in the detailed description and in conjunction with the following figures.

BRIEF DESCRIPTION OF THE DRAWINGS

The present disclosure is illustrated by way of example, and not by way of limitation, in the figures of the accompanying drawings and in which like reference numerals refer to similar elements and in which.

DETAILED DESCRIPTION

The present disclosure will now be described in detail with reference to a few preferred embodiments thereof as illustrated in the accompanying drawings. In the following description, numerous specific details are set forth in order to provide a thorough understanding of the present disclosure. It will be apparent, however, to one skilled in the art, that the present disclosure may be practiced without some or all of these specific details. In other instances, well known process steps and/or structures have not been described in detail in order to not unnecessarily obscure the present disclosure.

Various embodiments of the invention provide a gamifying exercise experience. Some embodiments increase exercise engagement and make the workout experience more immersive and intuitive. Providing live data from workouts can shift delayed gratification to immediate gratification via visualizations of metrics and progress, which increases engagement. Some embodiments provide dumbbells with a minimalist, modern aesthetic that looks good in the living room. If the dumbbell is unattractive and is hidden away, chances are it will not be utilized as much. Improving the dumbbell's design allows it to be a statement piece in one's home, which can drive engagement. Some embodiments provide similar improvements to other free weight exercise equipment as well, including barbells and kettlebells.

Figure 1:
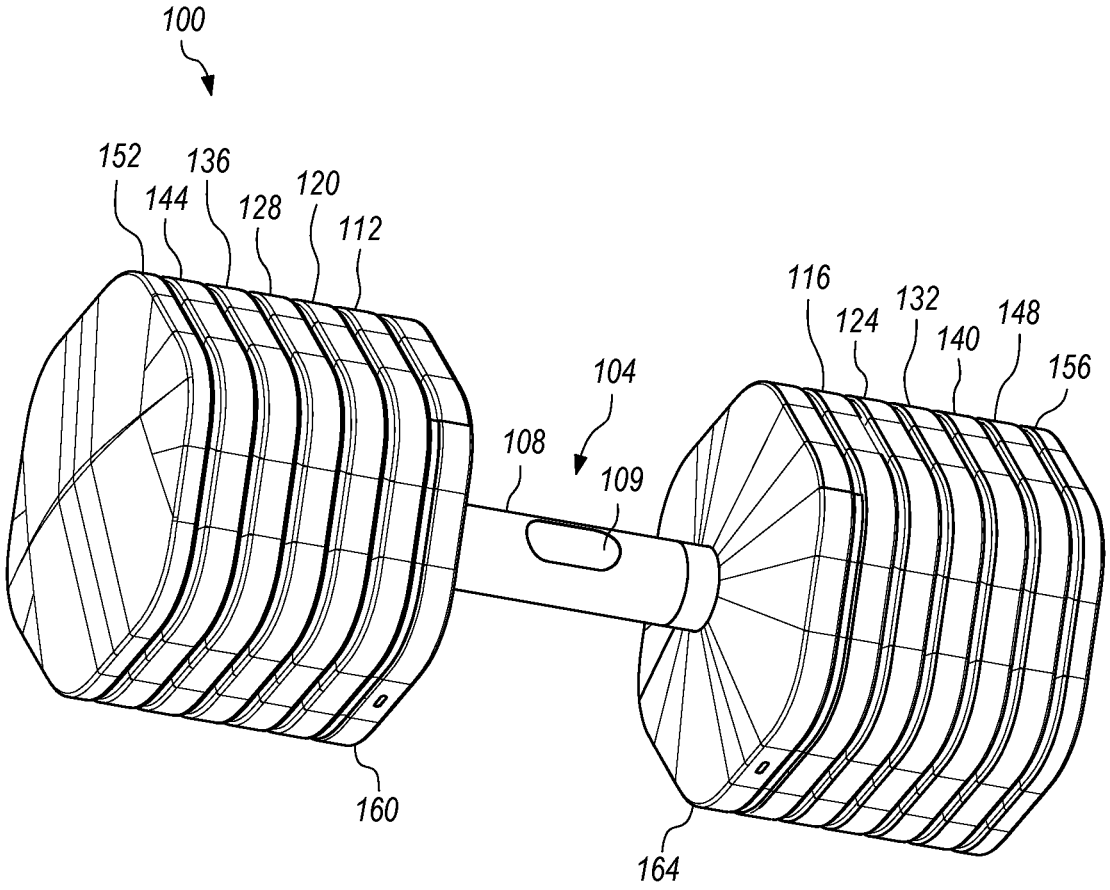
FIG. 1 is a perspective view of a dumbbell that may be used in some embodiments.

To facilitate understanding, FIG. 1 is a perspective view of a dumbbell 100 that may be used in some embodiments. The dumbbell 100 provides a dynamic adjustable weight device as part of a dynamic adjustable weight exercise system. In this embodiment, the dumbbell 100 comprises a permanent weight assembly 104, where the permanent weight assembly comprises a handle 108, a first weight 112 connected to a first end of the handle 108 and a second weight 116 connected to a second end of the handle 108. In this embodiment, the permanent weight assembly 104 further comprises at least one haptic pad 109. In various embodiments, the haptic pad 109 comprises a layer of pliable materials that would be easier for a haptic device to vibrate than thick metal. Such pliable materials may be rubber, silicone, or some other elastic material in addition to a soft plastic or cloth. In some embodiments, the permanent weight assembly 104 comprises at least two haptic pads 109.

In this embodiment, the dumbbell 100 further comprises a first interlocking weight 120 that is adapted to lock to a second side of the first weight 112 and a second interlocking weight 124 that is adapted to lock to a second side of the second weight 116. In this embodiment, the dumbbell 100 further comprises a third interlocking weight 128 that is adapted to lock to a second side of the first interlocking weight 120 and a fourth interlocking weight 132 that is adapted to lock to a second side of the second interlocking weight 124. In this embodiment, the dumbbell 100 further comprises a fifth interlocking weight 136 that is adapted to lock to a second side of the third interlocking weight 128 and a sixth interlocking weight 140 that is adapted to lock to a second side of the fourth interlocking weight 132. In this embodiment, the dumbbell 100 further comprises a seventh interlocking weight 144 that is adapted to lock to a second side of the fifth interlocking weight 136 and an eighth interlocking weight 148 that is adapted to lock to a second side of the sixth interlocking weight 140. In this embodiment, the dumbbell 100 further comprises a ninth interlocking weight 152 that is adapted to lock to a second side of the seventh interlocking weight 144 and tenth interlocking weight 156 that is adapted to lock to a second side of the eighth interlocking weight 148. In this embodiment, the ninth interlocking weight 152 and the tenth interlocking weight 156 are end weights with end covers. This embodiment further comprises a first trim weight 160 and a second trim weight 164.

In some embodiments, the first weight 112, the second weight 116, the first interlocking weight 120, the second interlocking weight 124, the third interlocking weight 128, the fourth interlocking weight 132, the fifth interlocking weight 136, the sixth interlocking weight 140, the seventh interlocking weight 144, the eighth interlocking weight 148, the ninth interlocking weight 152, and the tenth interlocking weight 156 are approximately the same weight. For example, these weights 112, 116, 120, 124, 128, 132, 136, 140, 144, 148, 152, 156 may be about 5 pounds. In some embodiments, the first trim weight 160 and the second trim weight 164 may be about the same. For example, the first trim weight 160 and second trim weight 164 may be about 2.5 pounds. In various embodiments, the first interlocking weight 120, the second interlocking weight 124, the third interlocking weight 128, the fourth interlocking weight 132, the fifth interlocking weight 136, the sixth interlocking weight 140, the seventh interlocking weight 144, and the eighth interlocking weight 148 are interchangeable.

Figure 2:
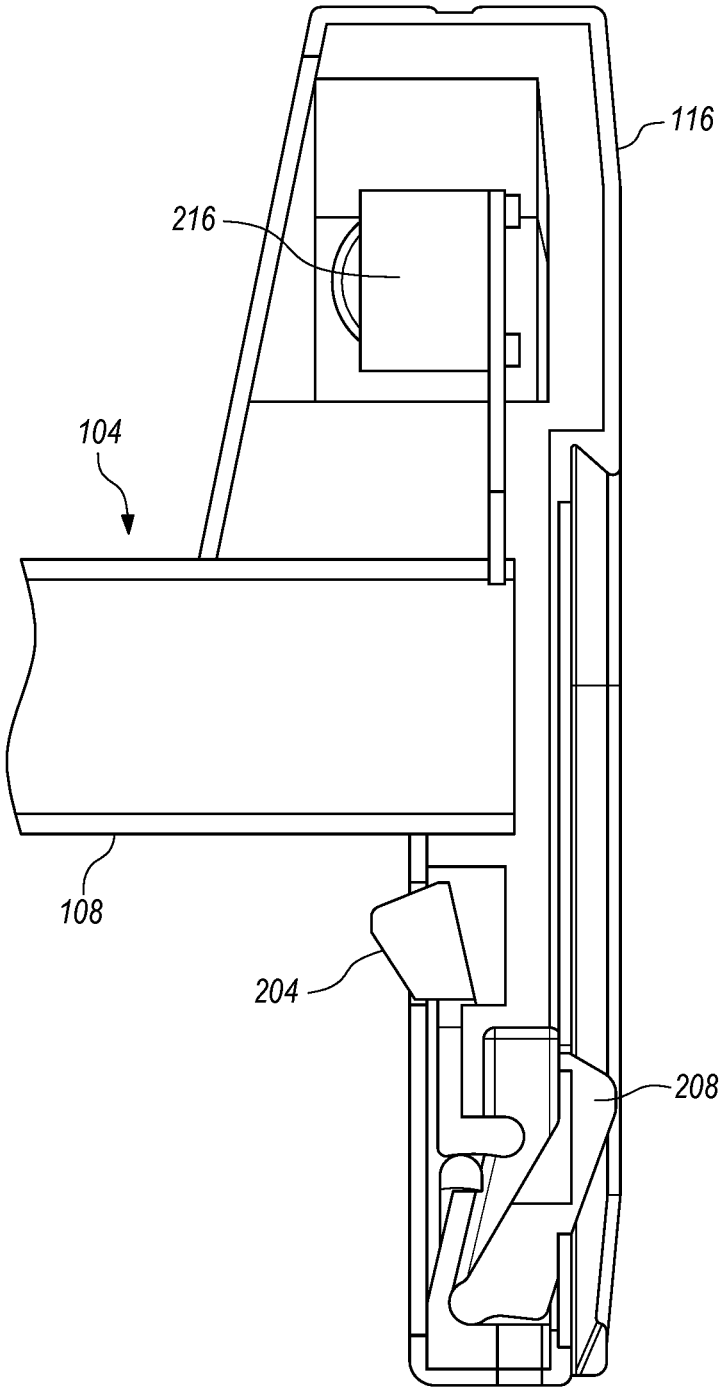
FIG. 2 is an enlarged cross-sectional view of part of the permanent weight assembly shown in FIG. 1.

FIG. 2 is an enlarged cross-sectional view of part of the handle 108 and the second weight 116. In this embodiment, the second weight 116 is attached to the handle 108. The second weight 116 comprises a trim latch 204 for locking the second trim weight 164 (shown in FIG. 1) to a first side of the second weight 116 and a weight latch 208 for locking the second interlocking weight 124 (shown in FIG. 1) to the second side of the second weight 116. In some embodiments, an electronic device 216 is part of the permanent weight assembly 104. In some embodiments, the electronic device is housed in the first weight 112 or the second weight 116. In some embodiments, the electronic device 216 comprises a sensor and a wireless transmitter and receiver. The wireless transmitter and receiver provide a permanent weight assembly communications device. Since the first weight 112, second weight 116 and handle 108 are permanently connected together instead of being locked by settings on a base, the first weight 112, second weight 116, and handle 108 form the permanent weight assembly 104.

Figure 3A:
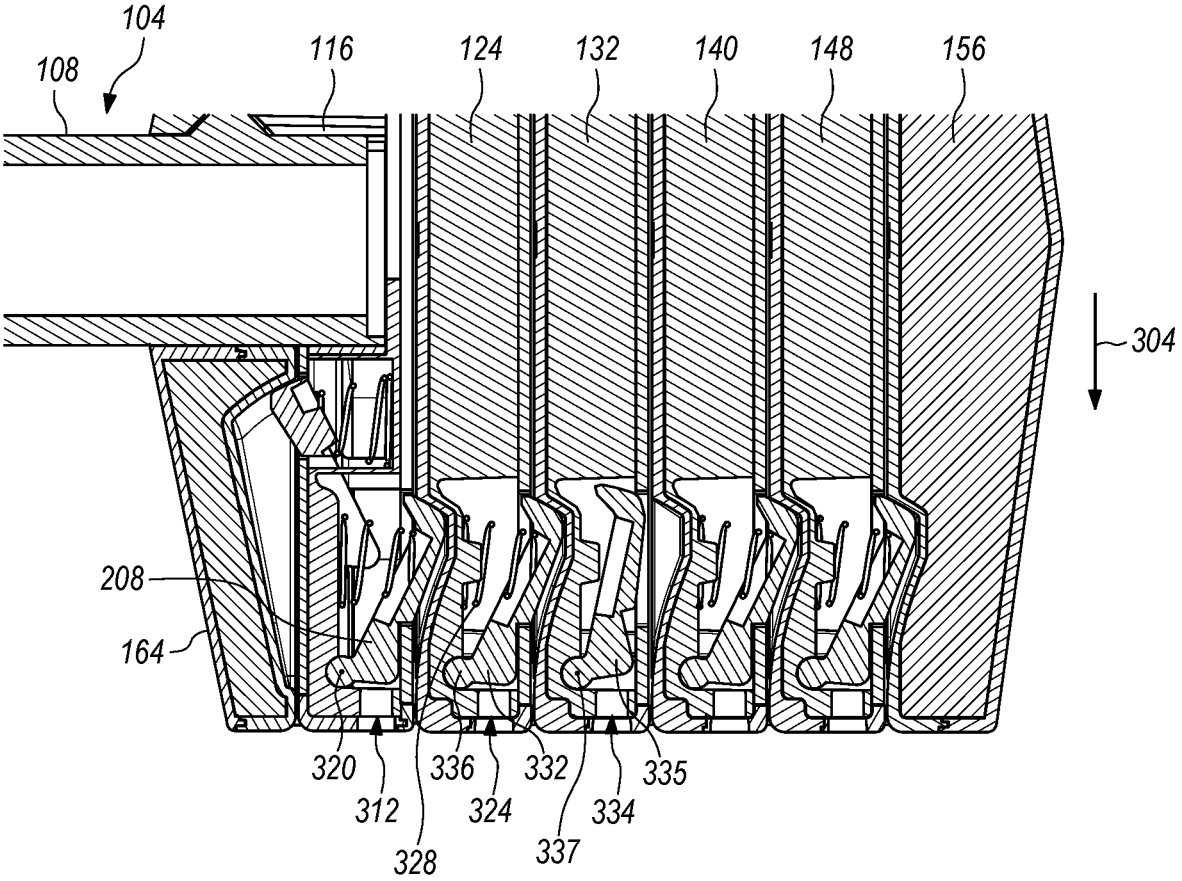
FIG. 3A is an enlarged cross-sectional view of part of the embodiments shown in FIG. 1.

FIG. 3A is an enlarged cross-sectional view of part of the handle 108, second weight 116, second interlocking weight 124, fourth interlocking weight 132, sixth interlocking weight 140, eighth interlocking weight 148, tenth interlocking weight 156, and second trim weight 164. Movement of the permanent weight assembly 104 in a first direction 304, which in this example is a vertically downward direction, causes the second weight 116 to engage with the second interlocking weight 124 and the second trim weight 164. In the example, shown in FIG. 3A a slot 334 on the fourth interlocking weight 132 provides clearance for a pin to enter and push upward against a latch 335 in the fourth interlocking weight 132 to rotate the latch 335 in a counter-clockwise position around pivot 337 to unlock the fourth interlocking weight 132 from the sixth interlocking weight 140, so that when the permanent weight assembly 104 is moved in a second direction opposite from the first direction, which in this example is in the upward direction, the sixth interlocking weight 140 disengages from the fourth interlocking weight 132 and the permanent weight assembly 104.

A pin associated to slot 324 on the second interlocking weight 124 is not pushed upward through the slot 324. A spring 328 in the second interlocking weight 124 rotates the latch 332 in the second interlocking weight in a clockwise direction around a pivot 336 in the second interlocking weight 124, so that the latch 332 locks the second interlocking weight 124 to the fourth interlocking weight 132. FIG. 3A schematically illustrates how weights can be locked or unlocked with respect to adjacent weights by moving latches.

In this embodiment, an interlocking weight is only locked to the permanent weight assembly 104, if all intervening interlocking weights between the interlocking weight and the permanent weight assembly 104 are locked. For example, in FIG. 3A, the fourth interlocking weight 132 is locked to the permanent weight assembly 104, because the fourth interlocking 132 weight is locked to the second interlocking weight 124 and the second interlocking weight 124 is locked to the second weight 116. However, although the eighth interlocking weight 148 is locked to the sixth interlocking weight 140, the eighth interlocking weight 148 is not locked to the permanent weight assembly 104, since the sixth interlocking weight 140 is not locked to the fourth interlocking weight 132. In the specification and claims, an interlocking weight is adjacently locked and is in an adjacently locked status if the interlocking weight and all intervening interlocking weights are set to be locked to the permanent weight assembly 104. Being set to be locked to the permanent weight assembly 104 is defined as being locked to the permanent weight assembly 104 or set so that when the permanent weight assembly 104 is placed on the base the interlocking weight is instantaneously locked to the permanent weight assembly 104.

Figure 3B:
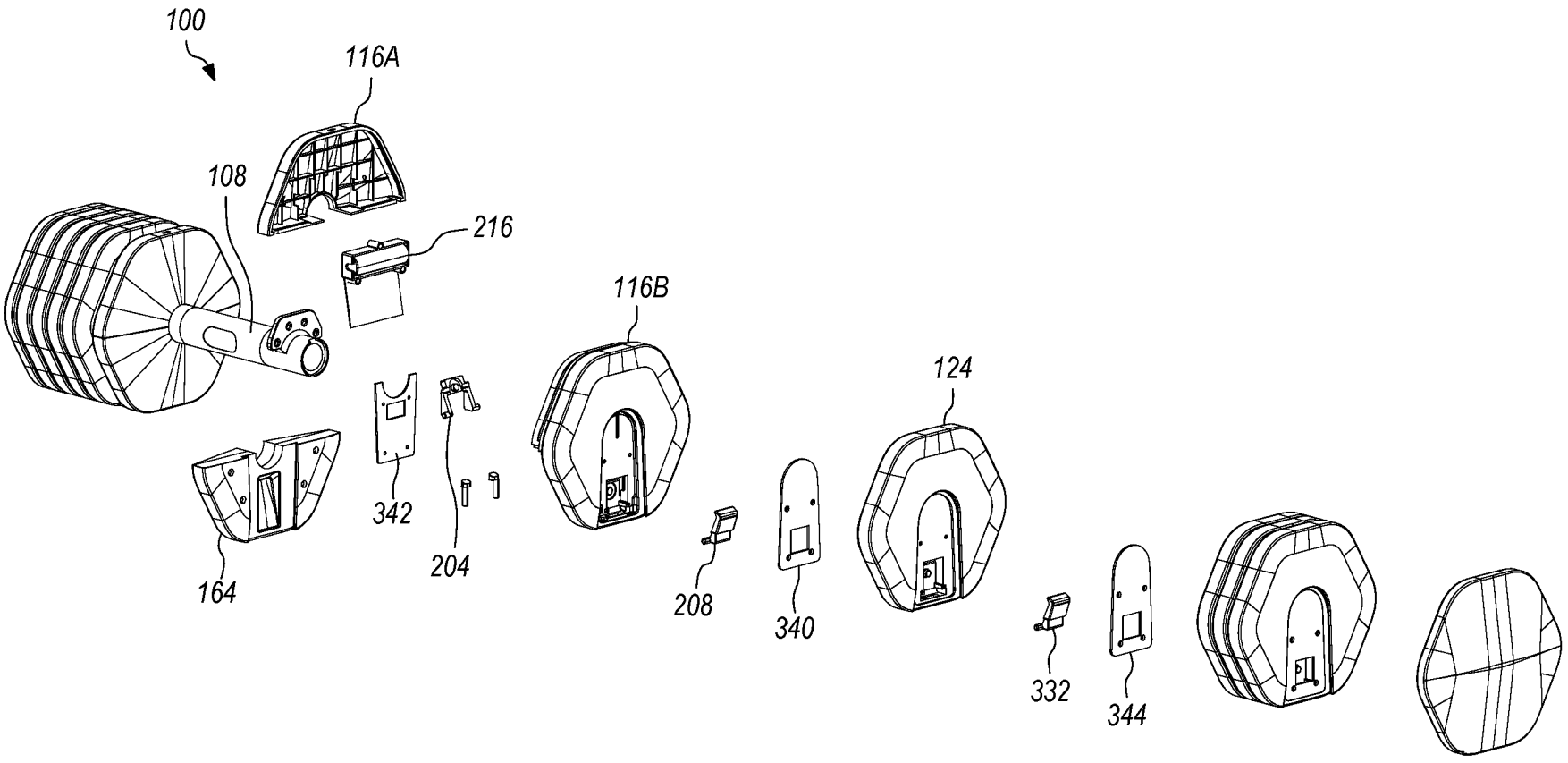
FIG. 3B is an exploded view of the embodiment shown in FIG. 1.

FIG. 3B is a perspective view of the dumbbell 100 where the second end is shown in an exploded view. The second weight comprises a second weight cover 116A, a second weight sub assembly 116B, and a second weight latch door 340. The second weight cover 116A is secured to the handle 108 by screws. The second weight cover 116A is joined to the second weight sub assembly 116B. In some embodiments, the second weight subassembly 116B has a central aperture, into which part of the handle 108 extends. The electronic device 216 is housed between the second weight cover 116A and the second weight sub assembly 116B. The weight latch 208, the second weight latch door 340, a trim weight door 342, and a trim weight latch 204 are mounted in the second weight 116A, B. The second interlocking weight 124 holds the latch 332 of the second interlocking weight 124 and is connected to a weight latch door 344.

Figure 3C:
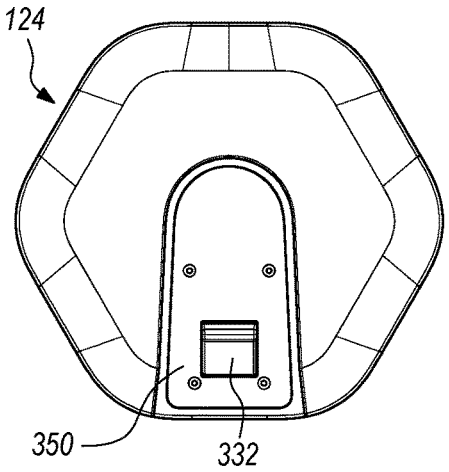
FIG. 3C is a side view of a second interlocking weight.
Figure 3D:
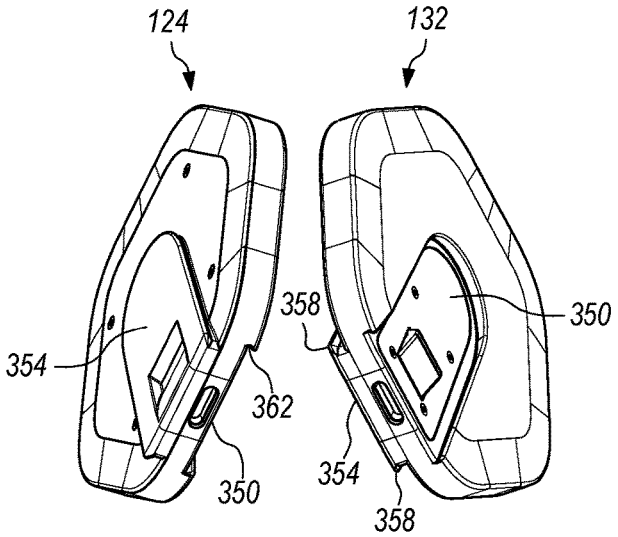
FIG. 3D is a perspective view of the second interlocking weight and a fourth interlocking weight.
Figure 3E:
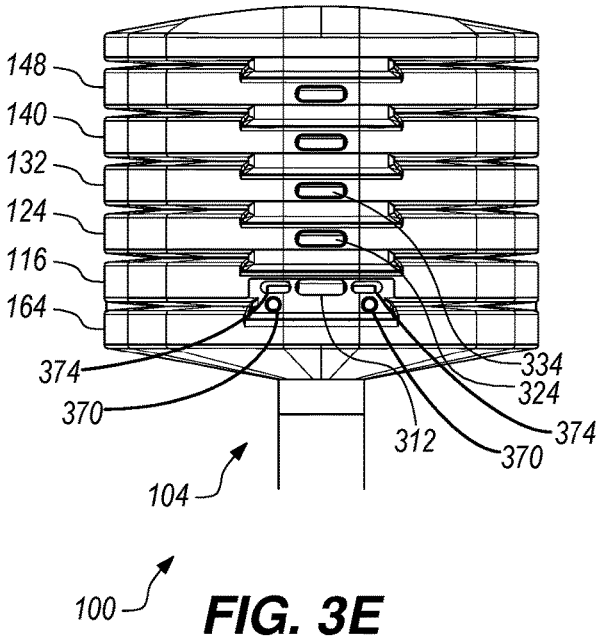
FIG. 3E is a bottom view of the second end of the dumbbell.
Figure 3F:
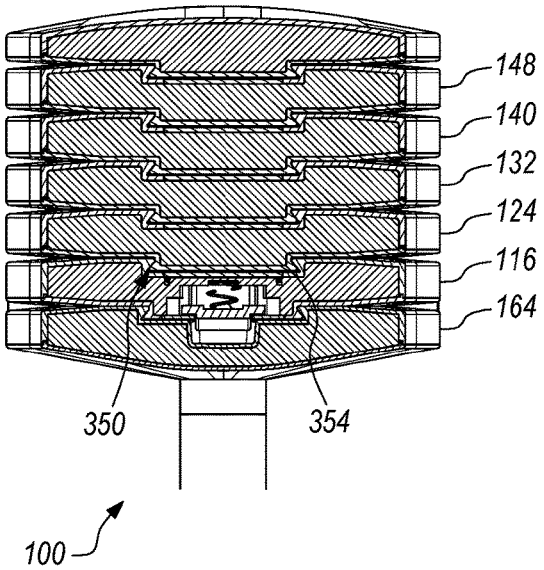
FIG. 3F is another cross-sectional view of the second end of the dumbbell.

FIG. 3C is a side view of the second interlocking weight 124, showing the weight latch 332 and an engaging groove 350 in front of the weight latch door 344. FIG. 3D is a perspective view of the second interlocking weight 124 and the fourth interlocking weight 132. Both the second interlocking weight 124 and the fourth interlocking weight 132 have engagement tongues 354 and engagement grooves 350. The engagement tongues 354 have a dovetail shape with acute outer corners 358. The engagement grooves 350 form dovetail shaped sockets with acute inner corners 362 that match the engagement tongues 354. The engagement grooves 350 and engagement tongues 354 have rounded tops and tapered sides, as shown, so that when the second interlocking weight 124 is moved in a first direction with respect to the fourth interlocking weight 132 the engagement groove 350 and engagement tongue 354 help to correct for any slight misalignment. FIG. 3E is a bottom view of the second end of the dumbbell 100 that shows the slots 312, 324, 334 and a bottom view of the engagement grooves and engagement tongues. FIG. 3E also show electrical contacts 370 for the permanent weight assembly 104. Trim weight slots 374 provide access to the trim weight latch 204. FIG. 3F is a cross-sectional view of the second end of the dumbbell 100 that shows a cross-sectional view of the engagement grooves 350 and engagement tongues 354. The engagement grooves 350 and engagement tongues 354 along with the weight latch 208 provide a directional engagement system that allows adjacent interlocking weights to engage and latch together by movement in a first direction and allows adjacent interlocking weights to disengage by movement in the second direction opposite from the first direction if adjacent weights are not locked together. In other embodiments other directional engagement systems may be provided. The spring loaded latches allow adjacent weights to be automatically locked by movement in the first direction unless the latches are in an unlock position.

Figure 4A:
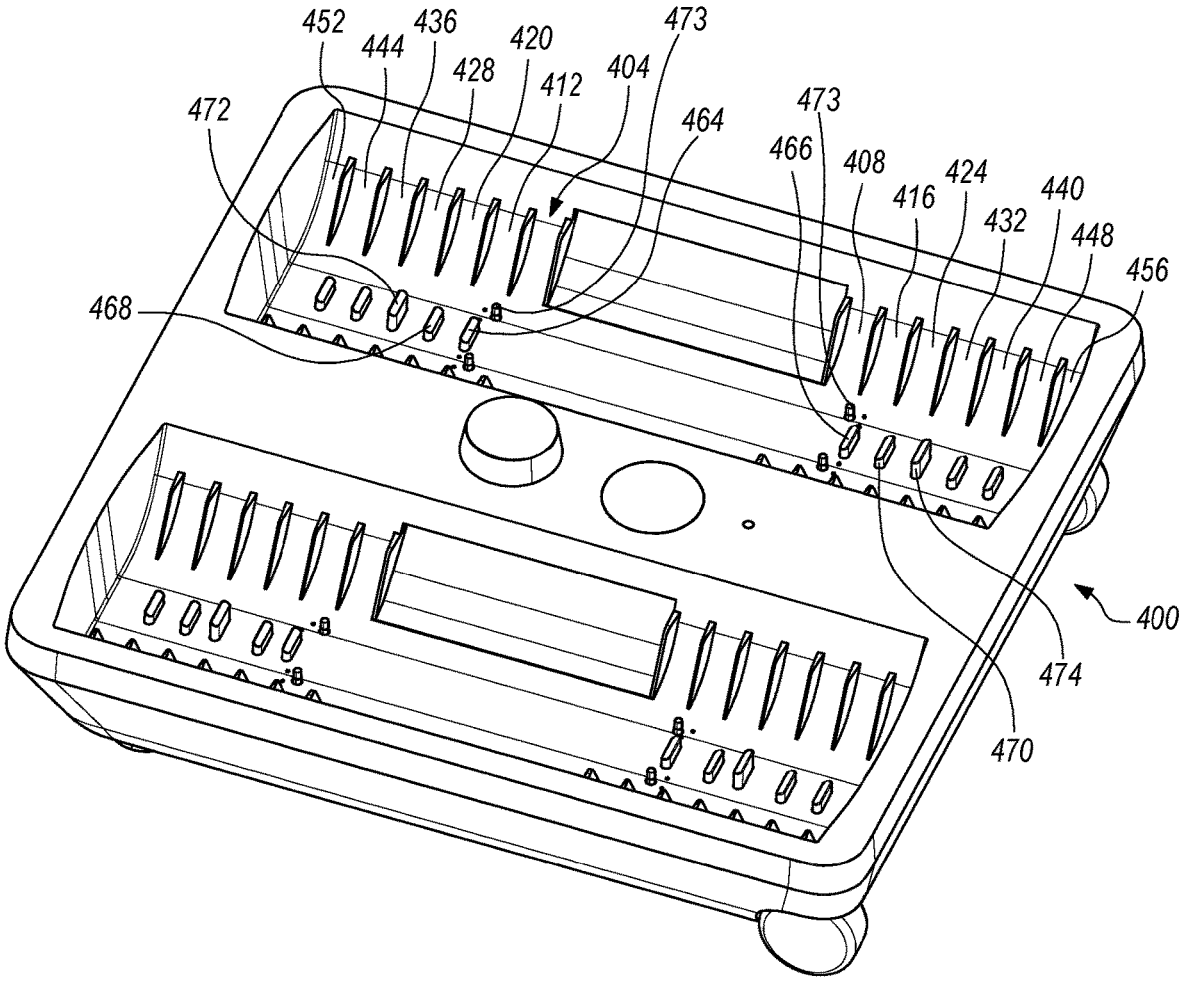
FIG. 4A is a perspective top view of a base used in some embodiments.

FIG. 4A is a top perspective view of a base 400 that may be used for the dumbbell 100, shown in FIG. 1, in some embodiments. The base has a first weight channel 404 and a second weight channel 408 that are adapted to hold the first trim weight 160 and the second trim weight 164, depending on the orientation of the dumbbell 100. A third weight channel 412 and a fourth weight channel 416 are adapted to hold the first weight 112 and the second weight 116, depending on the orientation of the dumbbell 100. A fifth weight channel 420 and a sixth weight channel 424 are adapted to hold the first interlocking weight 120 and the second interlocking weight 124, depending on the orientation of the dumbbell 100. A seventh weight channel 428 and an eighth weight channel 432 are adapted to hold the third interlocking weight 128 and the fourth interlocking weight 132, depending on the orientation of the dumbbell 100. A ninth weight channel 436 and a tenth weight channel 440 are adapted to hold the fifth interlocking weight 136 and the sixth interlocking weight 140, depending on the orientation of the dumbbell 100. An eleventh weight channel 444 and a twelfth weight channel 448 are adapted to hold the seventh interlocking weight 144 and the eighth interlocking weight 148, depending on the orientation of the dumbbell 100. A thirteenth weight channel 452 and a fourteenth weight channel 456 are adapted to hold the ninth interlocking weight 152 and the tenth interlocking weight 156, depending on the orientation of the dumbbell 100. The weight channels form an interlocking weight carrier for holding the interlocking weights on the base 400.

The third weight channel 412 has a first pin 464. The fourth weight channel 416 has a second pin 466. When raised, the first pin 464 and the second pin 466 would move the latch for the first weight 112, in FIG. 1, and the latch 208 in the second weight 116, shown in FIG. 3A, to allow the first weight 112 and second weight 116 to disengage with the first interlocking weight 120 and the second interlocking weight 124, respectively. Since the first pin 464 and the second pin 466 are in the lowered position, as shown, the first weight 112 would be locked to the first interlocking weight 120 and the second weight 116 would be locked to the second interlocking weight 124.

The fifth weight channel 420 has a third pin 468. The sixth weight channel 424 has a fourth pin 470. When raised, the third pin 468 and the fourth pin 470 would move the latch for the first interlocking weight 120, in FIG. 1, and move the latch 332 in the second interlocking weight 124, shown in FIG. 3A, to allow the first interlocking weight 120 and second interlocking weight 124 to disengage with the third interlocking weight 128 and the fourth interlocking weight 132, respectively. Since the third pin 468 and the fourth pin 470 are in the lowered position, the first interlocking weight 120 would be locked to the third interlocking weight 128 and the second interlocking weight 124 would be locked to the fourth interlocking weight 132.

The seventh weight channel 428 has a fifth pin 472. The eighth weight channel 432 has a sixth pin 474. When raised, the fifth pin 472 and the sixth pin 474 would move the latch for the third interlocking weight 128, in FIG. 1, and move the latch 335 in the fourth interlocking weight 132, shown in FIG. 3A, to allow the third interlocking weight 128 and fourth interlocking weight 132 to disengage with the fifth interlocking weight 136 and the sixth interlocking weight 140, respectively. In FIG. 4A, the fifth pin 472 and sixth pin 474 are raised so that the third interlocking weight 128 would disengage with the fifth interlocking weight 136 and the fourth interlocking weight 132 would disengage with the sixth interlocking weight 140.

Trim weight pins 473 are adapted to move the trim weight latch 204 in order to either lock or unlock the first trim weight 160 and the second trim weight 164. When the trim weight pins 473 are raised, the trim weight pins 473 would rotate the trim weight latch 204 in a clockwise direction in order to allow the second trim weight 164 to be unlocked, when the permanent weight assembly 104 is placed on the base 400. When the trim weight pins 473 are lowered, a spring rotates the trim weight latch 204 in a counter-clockwise direction in order to allow the second trim weight 164 to be locked when the permanent weight assembly is placed in or on the base 400.

Figure 4B:
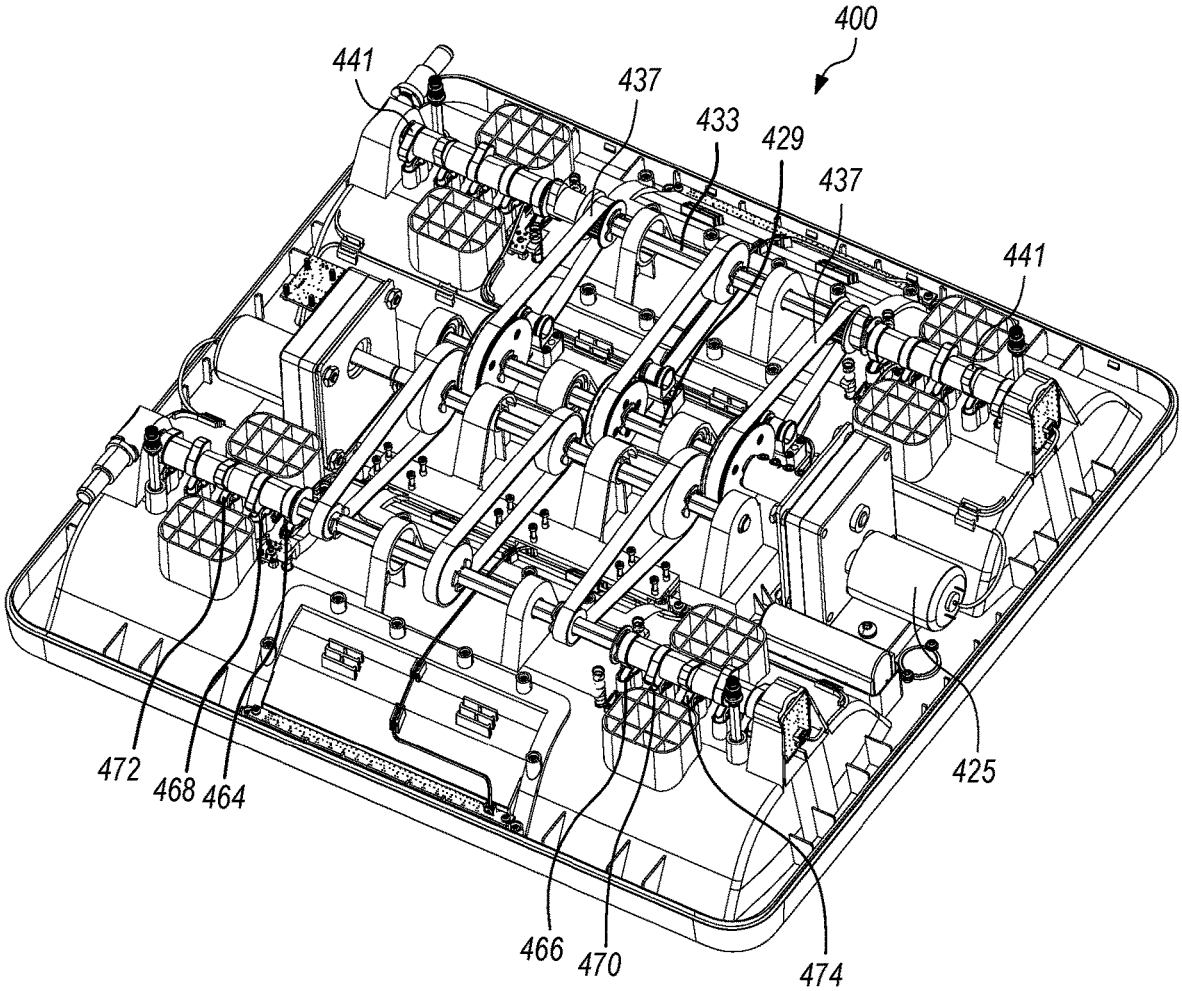
FIG. 4B is a perspective bottom uncovered view of the base shown in FIG. 4A.

FIG. 4B is a bottom perspective uncovered view of the base 400. A motor assembly 425 is adapted to drive a gear assembly 429 that is adapted to drive a plunger gear assembly 433 by the use of drive belts 437. Cams 441 are driven by the plunger gear assembly 433. The cams 441 cause the raising and lowering of the first, second, third, fourth, fifth, and other pins 464, 466, 468, 470, 472, 474. The motor assembly 425, gear assembly 429, plunger gear assembly 433, drive belts 437, cams 441 and pins provide an interlocking weight selector, which helps select which interlocking weights are locked. In this embodiment, the weight selector does not lock interlocking weights to the handle 108 but instead to adjacent interlocking weights and/or the first weight 112 or second weight 116. This is because the first weight 112 and the second weight 116 are permanently attached to the handle 118, instead of being locked to or unlocked from the handle 108 by the weight selector.

In some embodiments, in order to balance the dumbbell 100, the same amount of weight is provided on each end of the dumbbell. Therefore, pins are raised in pairs. As shown in FIG. 4B, the fifth pin 472 and sixth pin 474 are raised at the same time, while remaining pins are lowered. Such a configuration would keep the first interlocking weight 120, the second interlocking weight 124, the third interlocking weight 128, and the fourth interlocking weight 132 locked to the dumbbell 100, while remaining weights remain in or on the base 400. The dumbbell 100 would have equal weight on both ends, allowing the dumbbell to remain balanced. In addition, the dumbbell 100 is not dependent on orientation within the base 400.

Figure 5A:
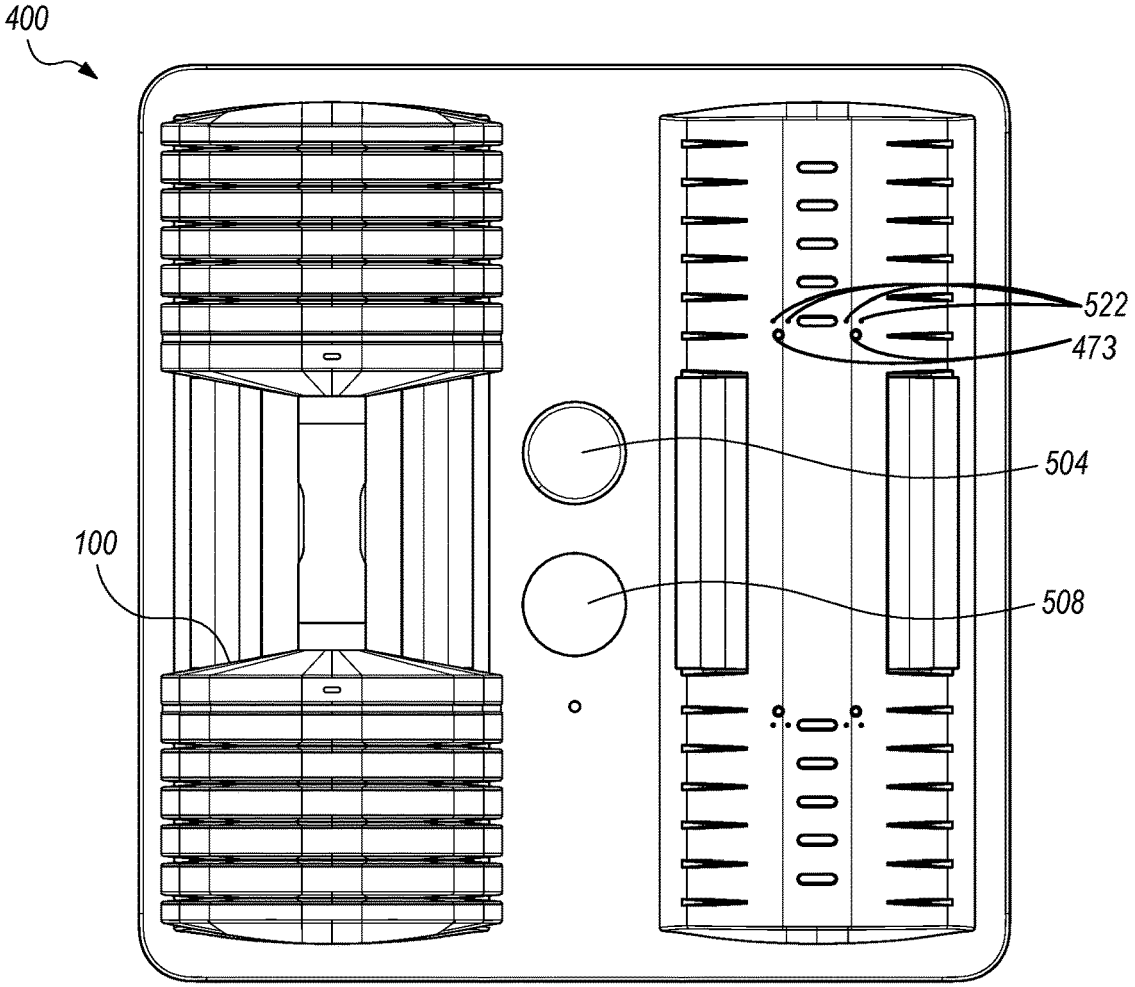
FIG. 5A is a top view of the base and dumbbell shown in FIG. 4A and FIG. 1, respectively.
Figure 5B:
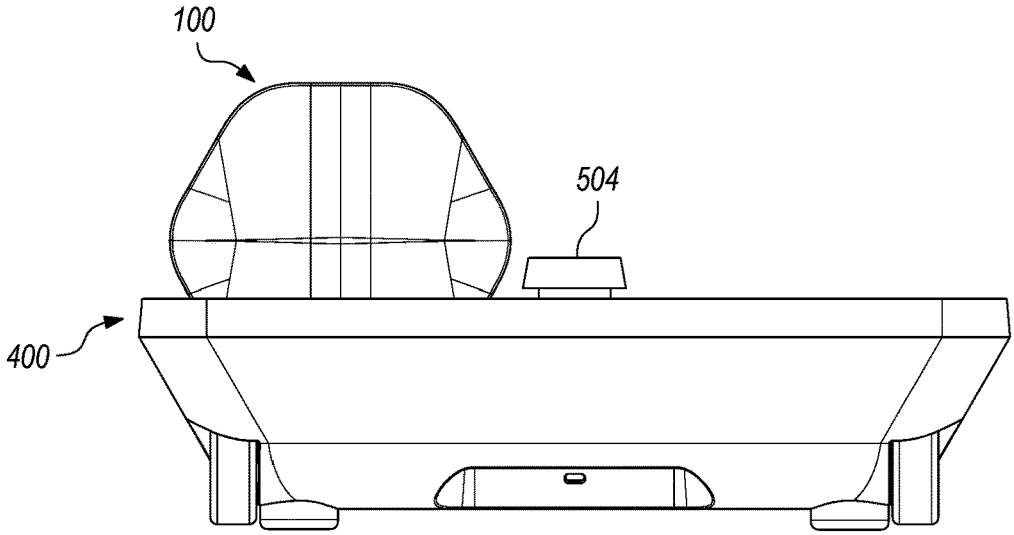
FIG. 5B is a rear view of the base and dumbbell shown in FIG. 5A.

FIG. 5A is a top view of the base 400 with a dumbbell 100. FIG. 5B is a rear view of the base 400 with the dumbbell 100 and a bottom housing. The base 400 is able to hold two dumbbells 100, so that a user may exercise using either two dumbbells at once or one dumbbell at a time. As shown, the dumbbell 100 is held in or on the base 400, with different weights being held in different weight channels. The base 400 has a dial 504 that may be used to select a desired weight. The dial 504 provides a weight selector interface. The base 500 may also have a display used 508 to display weight or other information.

Electrical contacts 522 for the base 400 are placed to make electrical contact with the electrical contacts 370 for permanent weight assembly 104. Contact between the electrical contacts 522 for the base and the electrical contacts 370 for the permanent weight assembly 104 provides a wired connection between the base 400 and the permanent weight assembly 104, when the permanent weight assembly 104 is placed in or on the base 400. The wired connection may be used for at least one of providing electrical charge and providing electrical communications. The electrical charge may be used to charge batteries in the permanent weight assembly 104 or to otherwise power the permanent weight assembly 104. In some embodiments, wireless charging may be used in place of wired charging.

Figure 6:
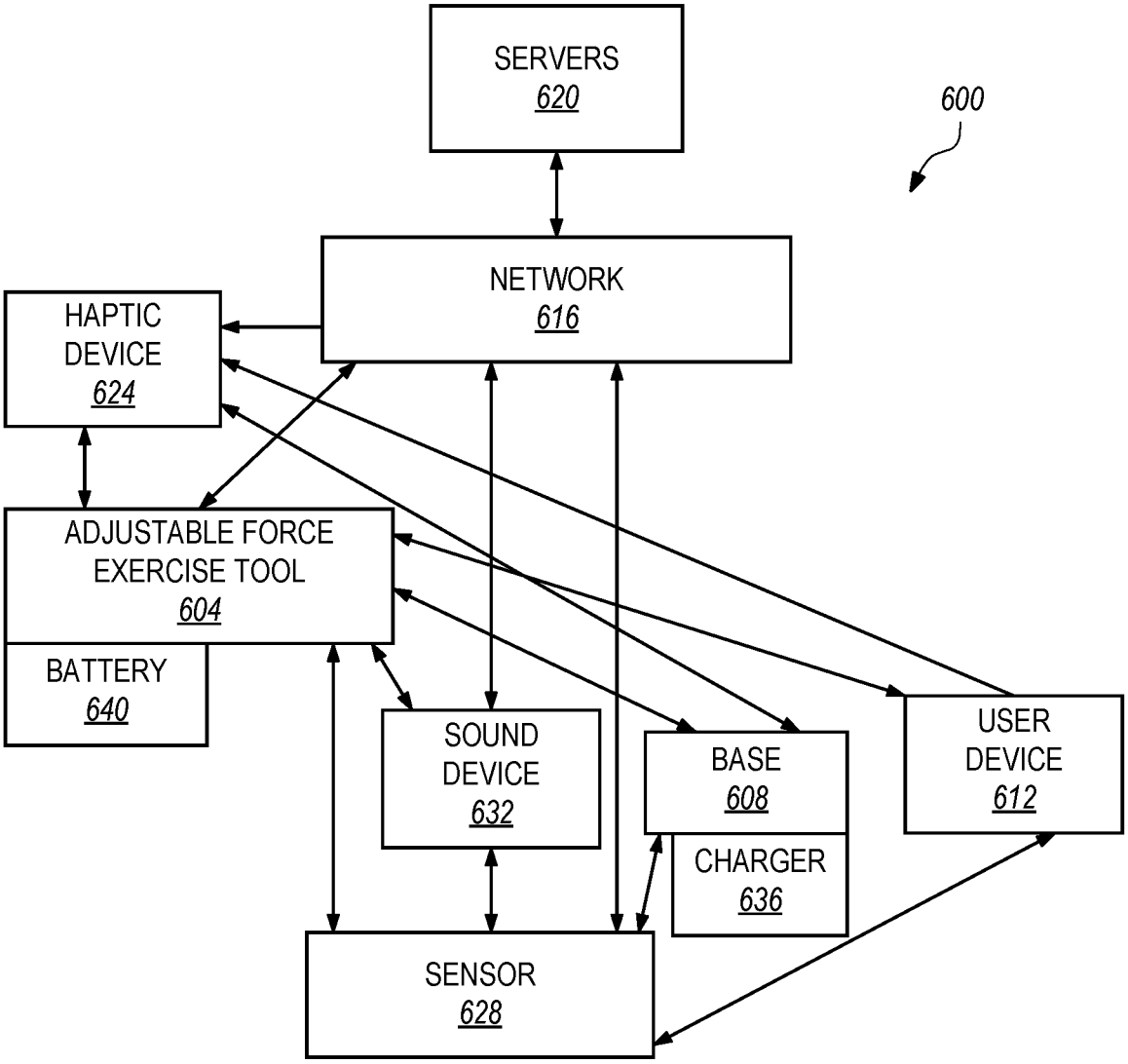
FIG. 6 is a schematic view of some embodiments.

FIG. 6 is a schematic view of an exercise system 600 used in some embodiments. The exercise system comprises an adjustable force exercise tool 604, such as the dumbbell 100, shown in FIG. 1. The exercise system 600 may further comprise a base 608, such as the base 400, as shown in FIG. 4A. The exercise system 600 may further comprise a user device 612, a network 616, and one or more servers 620.

A haptic device 624 is embedded in the adjustable force exercise tool 604. In some embodiments, the haptic device 624 is in physical contact with the haptic pad 109, shown in FIG. 1. In such embodiments, the haptic device 624 causes the haptic pad 109 to vibrate. The user's hand is in contact with the haptic pad 109, allowing the user to feel the haptic signals more easily. It has been found that the use of a pliable haptic pad 109 improved the sensing of haptic signals compared to haptic devices that generate a haptic signal that vibrates the entire adjustable force exercise tool 604. The use of the haptic pad 109 allows the haptic device 624 to vibrate the haptic pad 109 without requiring the vibration of the entire adjustable force exercise tool 604. The haptic pad 109 also allows for a haptic device that uses less power.

The exercise system 600 may have one or more sensors 628. In various embodiments, the sensors 628 may comprise one or more of a motion sensor, an accelerometer, a gyroscope, a magnetometer, an inertial measurement unit, an ultrasonic sensor, a heart rate monitor, an ultra-wideband device, a grip sensor, light sensor, and a barometer. In various embodiments, the light sensor may be an infra-red (IR), ultraviolet (UV), or optical light sensor, or camera. In various embodiments, the sensor 628 measures at least one of motion, orientation, linear and angular velocity, temperature, acceleration, position, magnetic field, heart rate, radio frequency, sound waves, and pressure. In various embodiments, the exercise system 600 further comprises a sound device 632. In various embodiments, the haptic device 624 receives input from one or more of the adjustable force exercise tool 604, base 608, user device, and network 616. The haptic device 624 provides vibrational or another touch sensory signal to the adjustable force exercise tool 604 that is recognized by a user. The user device 612 may be one or more of a mobile phone, tablet, computer, and camera. The mobile phone, computer, tablet, and/or camera may have an exercise system app. The user device 612 may be adapted to be a sensor in order to measure at least one of motion, orientation, linear and angular velocity, temperature, acceleration, position, magnetic field, heart rate, radio frequency, sound waves, and pressure. For example, the user device 612 may use a camera that is able to measure movement of a user. Since the user device 612 is not part of the adjustable force exercise tool 604 and the base 608, the user device 612 is considered a remote controller device.

In some embodiments, the exercise system 600 is used to increase workout motivation. For example, the exercise system 600 allows for the gamification of a workout. In some embodiments, the user device is a mobile phone with a workout app. In some embodiments the workout app communicates through the network 616 to servers 620, the adjustable force exercise tool 604, and the base 608. The servers 620 may be used to save workout data for the user and to generate workout regimens, also called exercise programs, for the user. In other embodiments, the user data and workout regimens may be stored on the user device 612 or in a computer/processor in the base 608.

In some embodiments, input from the sensor 628 may be also used to gamify the workout regimen. In some embodiments, the sensors 628 send input to at least one of the user device 612, base 608, or servers 620. The input may be used to determine at least one of completion of repetitions, the quality of the repetitions, metrics such as velocity, stability, or improper form, when the adjustable force exercise tool 604 is tilted, the type of movement or when a grip on the adjustable force exercise tool 604 is improper, such as being too soft, too hard or the wrong location. In some embodiments, a camera may send video input to the servers 620 that use the video to determine motion and number of repetitions. In some embodiments, the input may also be used for activity recognition. Motion detection may be combined with algorithms to detect a type of activity, such as whether a user is doing curls. In some embodiments, the activity recognition would be used to predict movement or may be used in determining weight settings.

In some embodiments, the workout regimen is adapted to send instructions to the base in order to specify the weight to be added or subtracted from the adjustable force exercise tool 604. In some embodiments, the haptics may be used to indicate at least one of when a required number of repetitions is completed, when the repetitions are performed improperly (such as too fast, too slow, or with improper form), when the adjustable force exercise tool 604 is improperly tilted, or when the user's grip on the adjustable force exercise tool 604 is improper, such as being too soft, too hard or the wrong location. If the workout is part of a game against other users or virtual challenge, the haptic tool may be used as a signal as part of the game. In some embodiments, sound from the sound device 632 or other sensory output may be used instead of a haptic signal.

In some embodiments, the sound device 632 is a sound generating device that provides a sound output. In some embodiments, the sound output or some other sensory output may be used in place of or in addition to the haptic output. In some embodiments, the sound device 632 and haptic device 624 or other output devices may be used as feedback devices where feedback may be provided in real time. In some embodiments, the base 608 has an electrical charger system 636 that is adapted to charge batteries 640 in the adjustable force exercise tool 604 or in the base 608. The battery 640 provides electrical power in order to power the haptic device 624 and sensors 628 in the adjustable force exercise tool 604.

Figure 7:
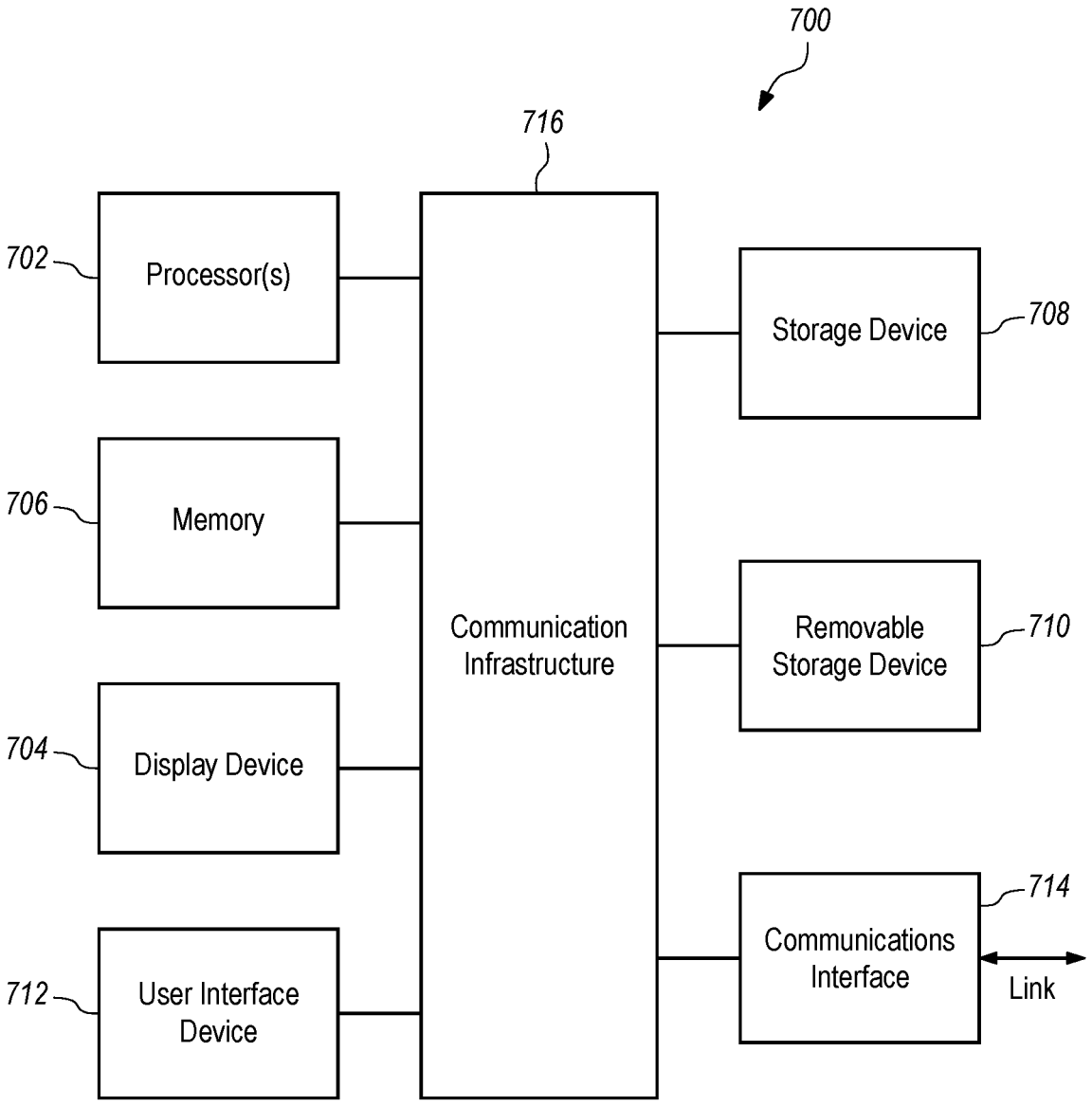
FIG. 7 is a schematic view of a computing system used in some embodiments.

FIG. 7 is a high level block diagram showing a computer system 700. The computer system 700 is suitable for implementing various embodiments. The computer system 700 may have many physical forms ranging from an integrated circuit, a printed circuit board, and a small handheld device up to a huge supercomputer. The computer system 700 includes one or more processors 702, and further can include an electronic display device 704 (for displaying graphics, text, and other data), a main memory 706 (e.g., random access memory (RAM)), storage device 708 (e.g., hard disk drive), removable storage device 710 (e.g., optical disk drive), user interface devices 712 (e.g., keyboards, touch screens, keypads, mice or other pointing devices, etc.), and a communications interface 714 (e.g., wireless network interface). The communications interface 714 allows software and data to be transferred between the computer system 700 and external devices via a link. The system may also include a communications infrastructure 716 (e.g., a communications bus, cross-over bar, or network) to which the aforementioned devices/modules are connected.

Information transferred via communications interface 714 may be in the form of signals such as electronic, electromagnetic, optical, or other signals capable of being received by communications interface 714, via a communications link that carries signals and may be implemented using wire or cable, fiber optics, a phone line, a cellular phone link, a radio frequency link, and/or other communications channels. With such a communications interface 714, it is contemplated that the one or more processors 702 might receive information from a network or might output information to the network in the course of performing the above-described method steps. Furthermore, method embodiments may execute solely upon the processors or may execute over a network such as the Internet, in conjunction with remote processors that share a portion of the processing.

The term "non-transient computer readable medium" is used generally to refer to media such as main memory, secondary memory, removable storage, and storage devices, such as hard disks, flash memory, disk drive memory, CD-ROM, and other forms of persistent memory and shall not be construed to cover transitory subject matter, such as carrier waves or signals. Examples of computer readable code include machine code, such as produced by a compiler, and files containing higher level code that are executed by a computer using an interpreter. Computer readable media may also be computer code transmitted by a computer data signal processor.

In some embodiments, the adjustable force exercise tool 604, the base 608, the user device 612, and the network 616 each have a communications interface 714 in order to provide communications between the various devices. A sensor in the adjustable force exercise tool 604 may use the communications interface 714 of the adjustable force exercise tool 604 or may have its own communications interface 714.

In some embodiments, the controller stores data from the sensors over the network and can run pattern recognition, data analysis, and machine learning models on a user's data set in order to analyze user specific metrics, such as fatigue, risk of injury (detection and prevention), engagement and fitness level. For example, the controller could analyze asymmetric motions in a user to determine if there is a high risk of injury and notify the user to prevent injury. In addition, the controller could allow detection of trends in motion over time and determine if a user is injured, sick, or fatigued. The controller could notify the user or a monitor. Some embodiments may provide other ways of analyzing and using user data to analyze user specific metrics and provide feedback to the user or others. The analysis may be done on servers through a network or on a user device or other device.

In various embodiments, the adjustable force exercise tool 604 may be free weights such as dumbbells, barbells, and kettlebells or weight machines, where the adjustment of the force is achieved by changing the weight attached to the adjustable force exercise tool 604. In some embodiments, the adjustable force exercise tool 604 may be other exercise equipment where force may be adjusted and where the interlocking weight selector systems are more generally force adjusters. In some embodiments, the adjustment of force is achieved by adjusting friction force or by adjusting load, tension, or compression in the adjustable force exercise tool 604.

In some embodiments, other interlocking weight selector systems, such as a plurality of digitally controlled solenoids or mechanical cranks may be used to move the latches. In some embodiments, instead of moving a latch, the changing of weight may be achieved by other methods of activation, such as pushing a button or triggering a switch. If other locking systems are used to lock the weights together, then the interlocking weight selector system may lock and unlock the weights in a different manner than using pins and/or latches. For example, if the locking system instead used a magnetic lock, then the weight selector system would be adapted to lock and unlock the magnetic locks.

In some embodiments, the first and second trim weights 160, 164 have a mass that is about half the mass of the first or second weights 112, 116, or the interlocking weights. In various embodiments, the first or second weights 112, 116 are about equal to the mass of the interlocking weights. In some embodiments, the first and second weight 112, 116, and interlocking weights have a mass of about 5 pounds (lbs.) and the first and second trim weights 160, 164 have a mass of about 2.5 lbs. Such an embodiment allows the weights to be increased at increments of 5 lbs.

In various embodiments, other latching systems may be used in order to engage or disengage the interlocking weights in order to provide a directional engagement system and locking system. In various embodiments, the weights and/or interlocking weights engage with adjacent interlocking weights when the weights and/or interlocking weights are moved in a first direction when placing the adjustable force exercise tool 604 into the base 608. In some embodiments, the weights and/or interlocking weights are disengaged from adjacent interlocking weights when the weights and/or interlocking weights are moved in a second direction opposite from the first direction, unless the weights and/or interlocking weights and adjacent interlocking weights are locked. In some embodiments, other locking systems may be used that allow locks between adjacent weights and/or interlocking weights to be set both when the adjustable force exercise tool 604 is removed from base 608 and when the adjustable force exercise tool 604 is in or on the base 608. In addition, in various embodiments, the locking system provides instantaneous locking between adjacent weights and/or interlocking weights when the adjustable force exercise tool 604 is placed on the base 608. The above described system of latches, springs, and pins shown in FIG. 1, FIG. 2, FIG. 3A, FIG. 3B, FIG. 4A, and FIG. 4B is an example of such an instantaneous locking system. In such embodiments, the pins 464, 466, 470, 472, 474 are raised and lowered so that when a dumbbell 100 is on the base 400 the pins 464, 466, 470, 472, 474 are raised and lowered to lock and/or unlock adjacent weights and/or interlocking weights. If the dumbbell 100 is not on the base 400, then placement of the dumbbell 100 on the base 400 causes the pins 464, 466, 470, 472, 474 to move the latches causing adjacent weights and/or interlocking weights to be either instantaneously locked or unlocked by placement of the dumbbell 100 into the base 400 in a first direction.

Other embodiments use other configurations in place of the directional engagement. Such embodiments may use beveled engagement grooves and matching engagement tongues. In other embodiments, other directional guides may be used to allow adjacent weights to engage when moved in a first direction and disengage when moved in a second direction and, in addition, provide placement correction, if the weights were not perfectly aligned.

In some embodiments, the weight selector interface is provided by an app on the user device 612 or a selector on the adjustable force exercise tool 604. In some embodiments, when the weight selector interface is provided by an app on the user device 612, the user device 612 may provide instructions or a control signal wirelessly to the interlocking weight selector system in the base 608 through a base wireless communication device. In addition, the transmitter and receiver in the permanent weight assembly 104 may transmit to and receive from one or more remote devices that are remote from the permanent weight assembly 104. Such remote devices may be a wireless transmitter and receiver in the base 608 or a user device 612 or some other device.

While this disclosure has been described in terms of several preferred embodiments, there are alterations, permutations, and various substitute equivalents, which fall within the scope of this disclosure. It should also be noted that there are many alternative ways of implementing the methods and apparatuses of the present disclosure. It is therefore intended that the following appended claims be interpreted as including all such alterations, permutations, and various substitute equivalents as fall within the true spirit and scope of the present disclosure. As used herein, the phrase "A, B, or C" should be construed to mean a logical ("A OR B OR C"), using a non-exclusive logical "OR," and should not be construed to mean 'only one of A or B or C. Each step within a process may be an optional step and is not required. Different embodiments may have one or more steps removed or may provide steps in a different order. In addition, various embodiments may provide different steps simultaneously instead of sequentially.

What is claimed is:

1. An adjustable weight exercise system, comprising:
a permanent weight assembly;
a plurality of interlocking weights;
a base; comprising:
an interlocking weight carrier, wherein the interlocking weights are supported on the interlocking weight carrier; and
an interlocking weight selector, wherein the interlocking weight selector is adapted to cause interlocking weights to be set to be locked to the permanent weight assembly, wherein placement of the permanent weight assembly on the base causes interlocking weights that are set to be locked to the permanent weight assembly to be locked to the permanent weight assembly, and wherein placement of the permanent weight assembly on the base does not cause interlocking weights that are not set to be locked to the permanent weight assembly to be locked to the permanent weight assembly; a weight selector interface, wherein the weight selector interface is configured for selecting a weight, wherein the weight selector interface is controllably connected to the interlocking weight selector, wherein the weight selector interface is adapted to cause interlocking weights to be set to be locked to the permanent weight assembly while the permanent weight assembly is not on the base.

2. The adjustable weight exercise system, as recited in claim 1, wherein all interlocking weights that are set to be locked to the permanent weight assembly are locked to the permanent weight assembly by placement of the permanent weight assembly on the base.

3. The adjustable weight exercise system, as recited in claim 1, wherein the interlocking weight selector is further adapted to place one or more interlocking weights in a locked or unlocked status while the permanent weight assembly is on the base.

4. The adjustable weight exercise system, as recited in claim 1, wherein the base, further comprises a base wireless communication device controllably connected to the interlocking weight selector.

5. The adjustable weight exercise system, as recited in claim 4, wherein the permanent weight assembly comprises:

a sensor adapted for measuring at least one of motion, orientation, linear and angular velocity, temperature, acceleration, position, magnetic field, heart rate, radio frequency, sound waves, and pressure, and providing output related to at least one of motion, orientation, linear and angular velocity, temperature, pressure, acceleration, position, magnetic field, heart rate, radio frequency, sound waves, and pressure; and a permanent weight assembly wireless communications device adapted for receiving and transmitting the output from the sensor, wherein the output from the sensor is used to provide a control signal to the interlocking weight selector.

6. The adjustable weight exercise system, as recited in claim 5, wherein the permanent weight assembly wireless communications device is adapted to transmit the output of the sensor to a first remote device and wherein the base wireless communication device is adapted to receive instructions from a second remote device.

7. The adjustable weight exercise system, as recited in claim 6, wherein the second remote device is the first remote device.

8. The adjustable weight exercise system, as recited in claim 5, wherein the sensor comprises at least one of a motion sensor, an accelerometer, a gyroscope, a magnetometer, an ultra-wideband device, an inertial measurement unit, an ultrasonic sensor, a heart rate monitor, a grip sensor, light sensor, and a barometer.

9. The adjustable weight exercise system, as recited in claim 1, further comprising at least one haptic device within the permanent weight assembly.

10. The adjustable weight exercise system, as recited in claim 1, wherein the permanent weight assembly, comprises:

a handle with a first end and a second end;

a first weight connected to the first end of the handle with a first side facing towards the second end of the handle and a second side facing away from the second end of the handle; and a second weight connected to the second end of the handle with a first side facing towards the first end of the handle and a second side facing away from the first end of the handle.

11. The adjustable weight exercise system, as recited in claim 10, wherein the plurality of interlocking weights, comprises:

a first interlocking weight that is adapted to lock to the second side of the first weight, wherein the first interlocking weight has a first side that is adapted to be locked to the second side of the first weight and a second side facing away from the first weight; and a second interlocking weight that is adapted to lock to the second side of the second weight, wherein the second interlocking weight has a first side that is adapted to be locked to the second side of the second weight and a second side facing away from the second weight.

12. The adjustable weight exercise system, as recited in claim 11, wherein the plurality of interlocking weights, further comprises:

a third interlocking weight that is adapted to lock to the second side of the first interlocking weight, wherein the third interlocking weight has a first side that is adapted to lock to the second side of the first interlocking weight and a second side facing away from the first interlocking weight; and a fourth interlocking weight that is adapted to lock to the second side of the second interlocking weight, wherein the fourth interlocking weight has a first side that is adapted to lock to the second side of the second interlocking weight and a second side facing away from the second interlocking weight.

13. The adjustable weight exercise system, as recited in claim 12, wherein the permanent weight assembly is placed into the base by movement in a first direction and removed out of the base by movement in a second direction opposite from the first direction, wherein the first weight engages with the first interlocking weight by movement of the permanent weight assembly into the base in the first direction and the second weight engages with the second interlocking weight by movement of the permanent weight assembly into the base in the first direction.

14. The adjustable weight exercise system, as recited in claim 13, wherein the first weight disengages with the first interlocking weight by movement of the permanent weight assembly out of the base in the second direction when the first weight is not locked to the first interlocking weight and the second weight disengages with the second interlocking weight by movement of the permanent weight assembly out of the base in the second direction when the second weight is not locked to the second interlocking weight and wherein the first interlocking weight remains engaged with the first weight and the second interlocking weight remains engaged with the second weight when permanent weight assembly is moved in the second direction out of the base, when the first interlocking weight is locked to the first weight and the second interlocking weight is locked to the second weight.

* * * * *